United States Patent [19]

Kunitz et al.

[11] Patent Number: 4,617,256

[45] Date of Patent: Oct. 14, 1986

[54] COLOR PHOTOGRAPHIC COLOR COUPLER-CONTAINING RECORDING MATERIAL

[75] Inventors: Friedrich-Wilhelm Kunitz, Leverkusen; Karl-Wilhelm Schranz, Odenthal-Hahnenberg, both of Fed. Rep. of Germany

[73] Assignee: Agfa Gevaert Aktiengesellschaft, Leverkusen, Fed. Rep. of Germany

[21] Appl. No.: 794,705

[22] Filed: Nov. 4, 1985

[30] Foreign Application Priority Data

Nov. 14, 1984 [DE] Fed. Rep. of Germany ..... 3441525

[51] Int. Cl.[4] ..... G03C 1/40

[52] U.S. Cl. ..... 430/557; 430/556

[58] Field of Search ..... 430/556, 557

[56] References Cited

U.S. PATENT DOCUMENTS 3,843,366 10/1974 Van Poucke et al. ..... 430/556
4,138,263 2/1979 Boie et al. ..... 430/557
4,510,234 4/1985 Matsuzaka et al. ..... 430/557

*Primary Examiner*—Richard L. Schilling
*Attorney, Agent, or Firm*—Connolly and Hutz

[57] ABSTRACT

Yellow Couplers of the formula wherein

Y represents an aliphatic or cycloaliphatic radical;

X represents hydrogen or a separable group;

$R^1$ represents an alkyl radical having from 12 to 20 carbon atoms; and $R^2$ represents an alkyl radical having from 1 to 4 carbon atoms, can be well dissolved in oil formers and also couple in the absence of benzyl alcohol with a high color yield. They are stable against heat and moisture and give rise to stable yellow dyes in color development.

4 Claims, No Drawings

COLOR PHOTOGRAPHIC COLOR COUPLER-CONTAINING RECORDING MATERIAL

This invention relates to a colour photographic recording material with at least one silver halide emulsion layer and a content of a non-diffusing emulsified α-acylacetanilide yellow coupler, the anilide group of which is substituted by an N-acylsulphamoyl group.

It is known to produce colour photographic images by chromogenic development, that is by developing imagewise exposed silver halide emulsion layers in the presence of suitable colour couplers by means of suitable colour-forming developer substances, so-called colour developers, whereby the oxidation product of the developer substances, produced in accordance with the silver image, reacts with the colour coupler with the formation of a dye image. Aromatic, primary amino group-containing compounds, particularly those of the p-phenylene diamine type, are normally used as colour developers.

A number of demands are generally made on the colour couplers, as well as on the dyes obtained therefrom by chromogenic development. Thus, the coupling speed of the colour couplers with the oxidation product of the colour developer should be as great as possible and as high a maximum colour density as possible should be obtained therefrom. The couplers as well as the dyes obtained therefrom must be sufficiently stable against light, elevated temperature and moisture. This applies both to fresh material as well as to processed material. For example, the remaining coupler still present in the image whites (non-image parts) of the processed material should not be yellow. Furthermore, the dyes should be sufficiently stable against gaseous reducing or oxidzing agents. They must, moreover, be fixed firmly against diffusion in the image layer and they should be deposited during chromogenic development in as fine a grain as possible. Finally, the dyes resulting from the colour couplers during chromogenic development should have a favourable absorption curve with a maximum which corresponds to the colour of the partial image desired in each case, and additional absorptions which are as low as possible.

To a great extent, the above-mentioned demands apply to yellow couplers, since in colour photographic recording materials these are frequently arranged in the uppermost colour-producing layer, and thus are not only substantially subjected to environmental influences, but also influence the layers lying thereunder, particularly with respect to sharpness. Therefore, all measures are advantageous by which the layer load, particularly of the yellow coupler-containing layer, can be reduced. For this reason, the use of 2-equivalent-yellow couplers is particularly advantageous.

α-Acrylactanilide-yellow couplers with an N-acylsulphonyl group on the anilide group are known, for example, from No. GB-A-909 318. The known yellow couplers, however, do not fulfill the demands made on them in every respect. A particular problem exists at present in that in some processing processes, the presence of benzyl alcohol is indispensible for achieving uniform high colour densities, particularly of the yellow dyes. The presence of benzyl alcohol in the developer, however, easily gives rise to the deposit of tarry compositions in the developer tank. A further disadvantage is based on the easy oxidizability of the benzyl alcohol, which requires that the developer bath be carefully monitored and kept constant in order to ensure uniform development results. It is thus desirable to develop such recording materials in the absence of benzyl alcohol.

SUMMARY OF THE INVENTION

The object of the invention is to provide yellow couplers for a colour photographic recording material, which can be well dissolved in oil formers and which can also be developed into yellow image dyes in the absence of benzyl alcohol in the developer with a high colour yield.

The invention provides a colour photographic recording material with at least one photosensitive silver halide emulsion layer and a non-diffusing α-acylacetanilide yellow coupler associated with this, the anilide group of which is substituted by an N-acylsulphamoyl group, characterised in that the yellow coupler corresponds to the following formula:

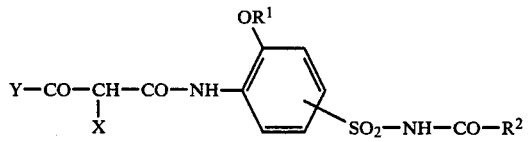

wherein:

Y represents an aliphatic or cycloaliphatic radical;

X represents a hydrogen atom or a group which can be split off during colour coupling;

$R^1$ represents an alkyl radical having from 12 to 20 carbon atoms;

$R^2$ represents an alkyl radical having from 1 to 4 carbon atoms.

DETAILED DESCRIPTION OF THE INVENTION

An aliphatic radical represented by Y is preferably a tert.-alkyl radical, particularly tert.-butyl. A cycloaliphatic radical represented by Y is, for example, a cyclohexyl, norbornyl or adamantyl radical.

A separable group during colour coupling represented by X is preferably a cyclic group bound via an oxygen atom or via a nitrogen atom, particularly a ring nitrogen atom, for example an optionally substituted 5- or 6-membered heterocyclic ring bound via a ring nitrogen atom. Such separable groups, also described as leaving groups, normally give the coupler the behaviour of a 2-equivalent coupler, that is the coupler requires only half as much silver halide for colour coupling as the corresponding 4-equivalent coupler in which X represents a hydrogen atom. Examples of suitable leaving groups are given in the following:

Leaving groups (1)

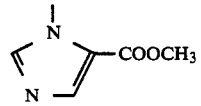

(2)

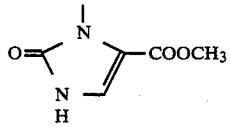

-continued
Leaving groups
(3)
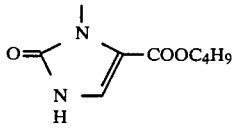
(4)
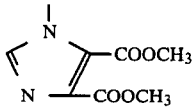
(5)
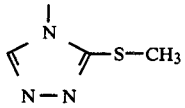
(6)
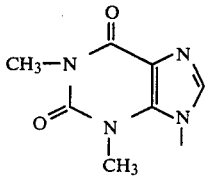
(7)
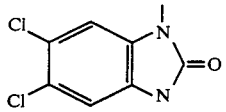
(8)
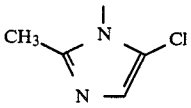
(9)
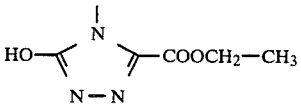
(10)
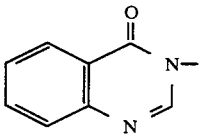
(11)
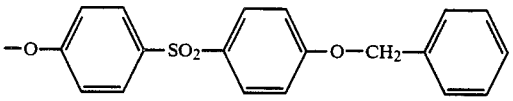
(12)
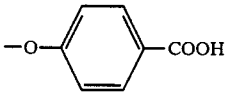
(13)
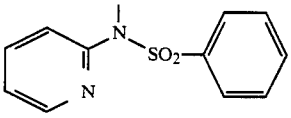
-continued
Leaving groups
(14)
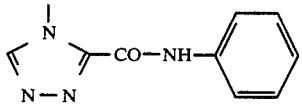
(15)
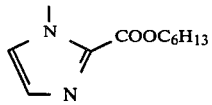
(16)
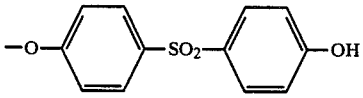
(17)
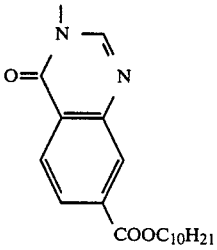
(18)
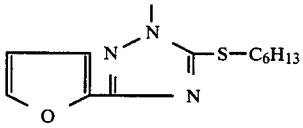
Some examples of the yellow couplers according to invention are given in the following:
1.
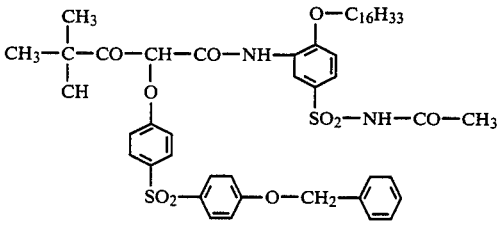
MP: 152–154° C.
2.
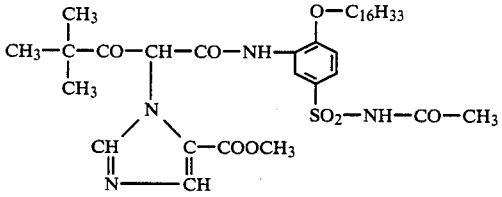
MP: 193° C.
3.
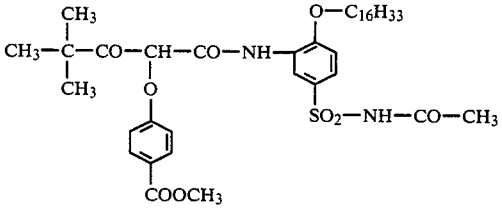
MP: 155–157° C.

-continued
4.
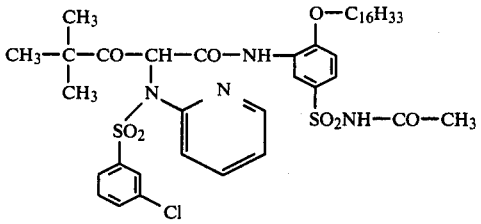
MP: 152–153° C.
5.
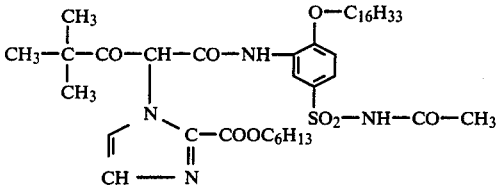
solidified oil
6.
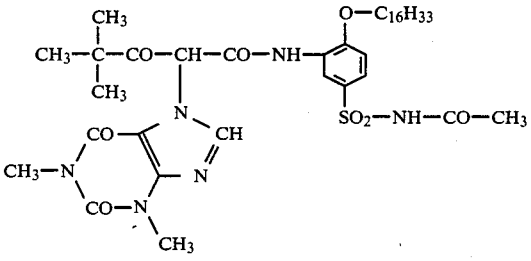
solidified oil
7.
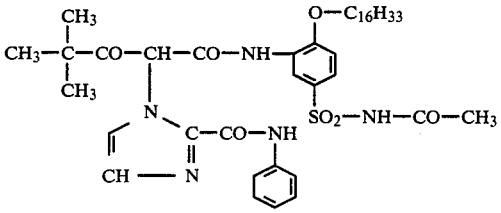
MP: 136–137° C.
8.
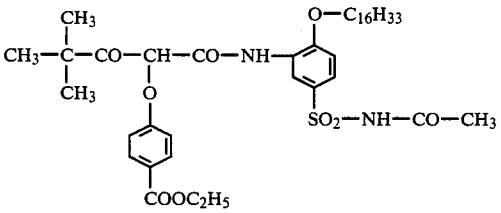
MP:134–135° C.
9.
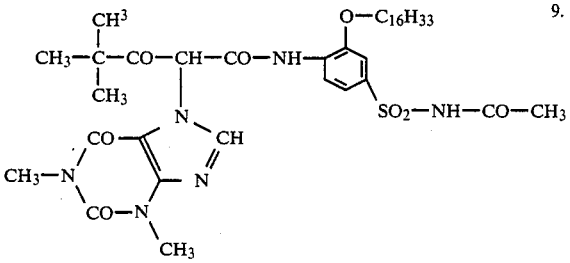
MP: 135° C.
-continued
10.
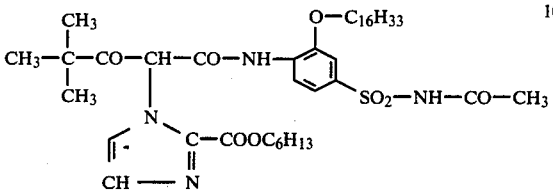
MP: 78° C.
11.
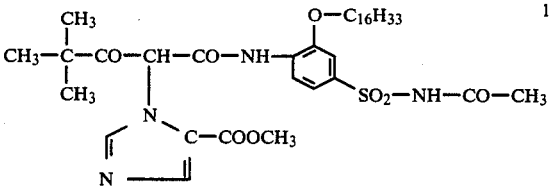
MP: 163° C.
12.
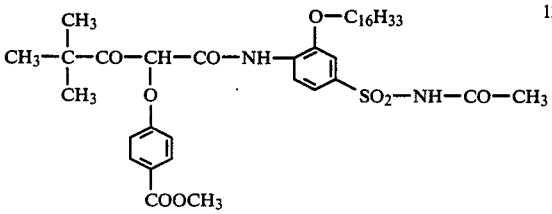
MP: 107–108° C.
13.
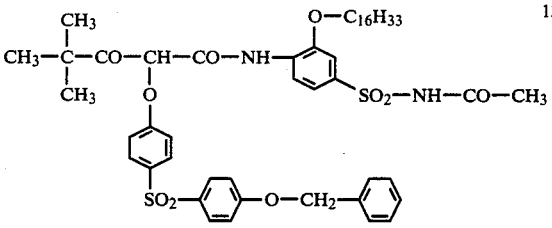
MP: solidified oil
14.
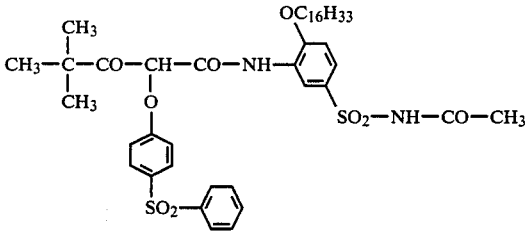
15.
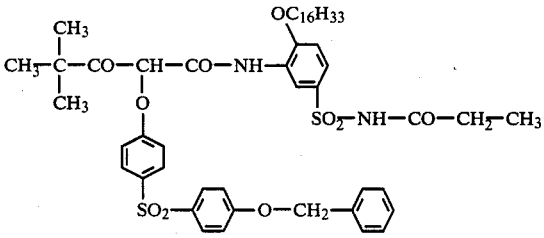
16.
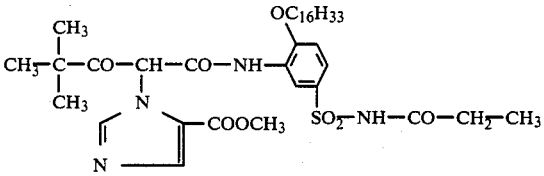

-continued

17.

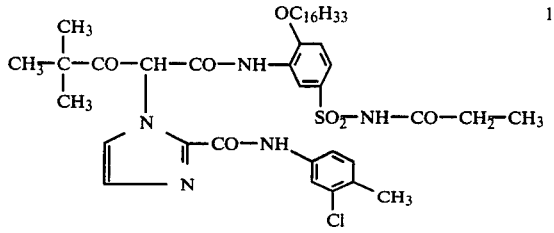

18.

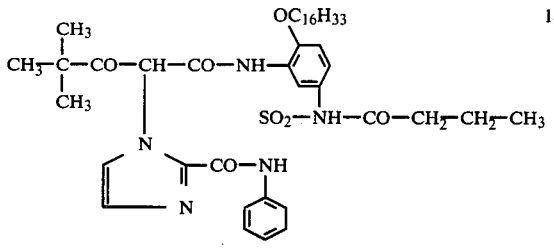

The production of the yellow couplers according to the invention is explained in the following using as an example the synthesis of compound 1.

Stage 1

2-Acetamido-phenol-sulphonic acid-(4)-amide 1850 ml of methanol are suspended in 376 g (2 ml) of 2-aminophenol-sulphonic acid (4) amide. 209 ml of acetic acid anhydride are added dropwise with stirring at boiling temperature. Subsequent stirring takes place for a further 30 min, followed by cooling to 10° C. The acetyl product is drawn off by suction and washed with methanol and ether. The yield of almost pure white 2-acetamido-phenol-sulphonic acid-(4)-amide is 378 g (82% of the theoretical yield).

MP: 237°-239° C.

Stage 2

3-Acetamido-4-cetyloxy-benzene sulphonic acid-(1)-amide

A solution of 230.2 g (1 mol) of 2-acetamido-phenol-sulfonic acid-(4)-amide and 305 g (1 mol) of cetyl bromide in 800 ml of dimethyl formamide is added dropwise at 100° C. within about 30 min to 180 ml of a 30% Na-methylate solution. The mixture is stirred for 2 h at 109° C. and then stirred further in iced water. The product washed with water until neutral and finally with alcohol.

For purification, the crude product is dissolved by heating in 850 ml of dimethyl formamide, filtered and precipitated with 850 ml of alcohol. The crystalline product is drawn off by suction at room temperature and washed with water. The yield is 341 g (75% of the theoretical yield) of white crystals, MP: 158°-159° C.

Stage 3

2-Cetyloxy-5-sulphamoyl-aniline 454 g (1 mol) of 3-acetamido-4-cetyloxy-benzene sulphonic acid-(1)-amide are suspended in 1400 ml of n-propanol and 360 ml of concentrated HCl. Heating is carried out to boiling point, whereupon all the material is dissolved. After 45 min the reaction mixture is stirred in iced water, in which 550 ml of concentrated ammonia has been additionally mixed. The amine is drawn off by suction, washed until neutral with water and then with methanol. The product thus obtained with a MP: 103°-105° C. is chromatographically pure. The yield is 398 g (97% of the theoretical yield).

Stage 4

2-Cetyloxy-5-sulphamoyl-pivaloylacetanilide 206 g (0.5 mol) of 2 -cetyloxy-5-sulphonamidoaniline are heated with 86 g (0.5 mol) of pivaloyacetic ester to 150° C. Alcohol is released thereby. After 2 h, 4.5 g of pivaloylacetic ester are added to the reaction mixture and, after a further hour, another 4.5 g of pivaloyacetic ester are added to the reaction mixture. The melt is left for 1 h at a bath temperature of 160° C. and is then stirred in 550 ml of methanol. The crude product is drawn off by suction at room temperature and washed with methanol. After recrystallizing from 450 ml of alcohol, 159 g (59% of the theoretical yield) of an almost white product are obtained;

MP: 143° C.

Stage 5

2-Cetyloxy-5-N-acetylsulphamoyl-pivaloylacetanilide 269 g (05. mol) of the coupler from stage 4 are dissolved by warming in 1000 ml of glacial acetic acid. 40 ml of acetyl chloride are added dropwise at 50° C. After 15 min in each case, 40 ml of acetyl chloride are added a further two times. Subsequent stirring is carried out for 1 h and then the product is stirred in iced water. The product, which is viscous at the outset, crystallizes after decanting the aqueous phase and is washed with water after renewed stirring. By recrystallization of the still moist crude product with methanol, 255 g (88% of the theoretical yield) of chromatographically pure coupler are obtained;

MP: 100°-101° C.

Stage 6

290 g (0.5 mol) of the coupler from stage 5 are dissolved in 1500 ml of methylene chloride and treated dropwise at room temperature with 45 ml (0.55 mol) of sulphuryl chloride. Subsequent stirring is carried out for 1 h at room temperature. The methylene chloride is then completely distilled off at 20° C. under vacuum. The residue (very viscous oil) is dissolved by heating in 500 ml of acetonitrile. The product is cooled to room temperature, drawn off by suction and washed with acetonitrile. The yield is 275 g (89% of the theoretical yield) of white crystals with a melting point of 107° C.

Stage 7

Compound 1

294 g (0.6 mol) of 4-hydroxy-4'-benzyloxy-diphenyl-sulphone are suspended in 500 ml of dimethyl acetamide and treated with 128 ml (1 mol) of tetramethyl guanidine. The solution of 307 g (0.5 mol) of the chlorinated coupler from stage 6 is added dropwise to 1000 ml of dimethyl acetamide, with stirring, at an interior temperature of from 60° to 65° C. Subsequent stirring is carried out for a further 1 h at from 75° to 80° C. on completion of the dropwise addition. The reaction mixture is further stirred in a mixture of iced water and HCl. The precipitate is drawn off by suction and washed with water. The crude product is dissolved in aqueous acetic acid, dried with sodium sulphate and treated with active carbon. The ethyl acetate distilled off under vacuum. The residue is recrystallized from alcohol. 289 g of the 2-equivalent coupler compound 1 are obtained.

MP: 152°–154° C.

The yellow couplers according to the invention are above all distinguished by an excellent solubility and low crystallization tendency in organic solvents, particularly in water-immiscible solvents with a high boiling point, such as a tricresylphosphate-isomer mixture or dibutyl phthalate. This has a favourable effect with respect to a relatively low layer load.

Moreover, they have an excellent diffusion stability in photographic layers, both in the casting process and during photographic processing.

A further advantage of the yellow couplers according to the invention is their high stability against moisture and heat, as well as the stability of the yellow dyes produced therefrom against heat, mositure and light irradiation.

Finally, a further advantage is that the yellow couplers according to the invention give satisfactory sensitometric results even during processing in the absence of benzyl alcohol, without having to sacrifice colour density.

In the production of the photosensitive colour photographic recording material, the diffusion-resistant yellow couplers of the present invention can be incorporated in known manner in the casting solution of the silver halide emulsion layers or other colloid layers. For example, the oil-soluble or hydrophobic yellow couplers can preferably be added to a hydrophilic colloid solution from a solution in a suitable coupler solvent (oil former), optionally in the presence of a wetting or dispersing agent. The hydrophilic casting solution can naturally contain other usual additives in addition to the binding agent. The solution of the colour coupler does not need to be directly dispersed in the casting solution for the silver halide emulsion layer or another water-permeable layer; rather, it can firstly also be dispersed advantageously in an aqueous non-photosensitive solution of a hydrophilic colloid, whereupon the mixture obtained is mixed before application, with the casting solution for the photosensitive silver halide emulsion layer or another water-permeable layer, after removing the organic solvent used.

Emulsions of silver chloride, silver bromide or mixtures thereof, optionally with a low content of silver iodide of up to 10 mol-%, in one of the conventionally used hydrophilic binding agents are suitable as photosensitive silver halide emulsions. Gelatin is preferably used as binding agent for the photographic layers. This can, however, be completely or partially replaced by other natural or synthetic binding agents.

The emulsions can be chemically or spectrally sensitized in the usual manner and the emulsion layer, as well as other non-photosensitive layers can be hardened in the usual manner with known hardening agents.

For the production of colour-photographic images, the colour photographic recording material according to the invention, which contains at least one silver halide emulsion layer and a new yellow coupler associated therewith, is developed with a colour developer compound. The yellow coupler can be contained in the silver halide emulsion layer itself or also in an adjacent non-photosensitive binding agent layer. Numerous developer compounds can be used as colour developer compound, which have the ability to react in the form of their oxidation product with colour couplers to produce azomethine dyes. Suitable colour developer compounds are aromatic compounds containing at least one primary amino group of the p-phenylene diamine type, for example, N,N-dialkyl-p-phenylenediamines, such as N,N-diethyl-p-phenylenediamine, 1-(N-ethyl-N-methylsulphonamido-ethyl)-3-methyl-p-phenylenediamine, 1-(N-ethyl-N-hydroxyethyl-3-methyl-p-phenylenediamine and 1-(N-ethyl-N-methoxyethyl)-3-methyl-p-phenylenediamine.

Example 8 mmol of each of the following couplers are dissolved in 15 ml of ethyl acetate, 5 ml of dibutyl phthalate and 5 ml of a 10% aqueous solution of the sodium salt of a $C_{12}$-alkylnaphthylsulphonic acid and emulsified at 60° C. in 150 ml of 7.5% aqueous gelatin solution. 126 ml of a silver bromide chloride emulsion (90 mol-% of AgBr), with a silver content which corresponds to 6.8 g of $AgNO_3$, are added to the prepared emulsion. This casting solution is poured onto a polyethylene-coated paper at 40° C. with an application of 1.5 g of $AgNO_3$ per $m^2$.

The samples are exposed behind a grey step wedge, developed in the following defined colour developer, once with and once without benzyl alcohol and then bleach-fixed, washed and dried.

| Colour developer | |
|---|---|
| (benzyl alcohol | 15 ml) |
| potassium carbonate | 30 g |
| potassium bromide | 0.5 g |
| hydroxylamine sulphate | 2 g |
| sodium sulphite | 2 g |
| diethylene triamine | 1 g |
| N—ethyl-N—β-methane sulphonamidoethyl-3-methyl-4-aminoaniline sulphate | 4.5 g |
| made up with water to | 1 l |

| Bleach-fixing bath | |
|---|---|
| ammonium thiosulphate (70%) | 150 ml |
| sodium sulphate | 5 g |
| Na[Fe (EDTA)] | 40 g |
| EDTA | 4 g |
| made up with water to | 1 l |

| Colour development process | Temperature (°C.) | Time |
|---|---|---|
| 1. colour development | 33 | 3 min 30 sec |
| 2. bleach-fixing | 33 | 1 min 30 sec |
| 3. washing with water | 26 | 2 min |
| 4. drying | | |

The processed samples show the sensitometric differences listed in the following table with respect to sensitivity, whereby E1–E2 gives the difference in the sensitivities (DIN) which were obtained with or without benzyl alcohol, and D1 and D2 give the maximum colour densities obtained with (D1) or without (D2) benzyl alcohol. The compound of the following formula is also tested as a comparative coupler.

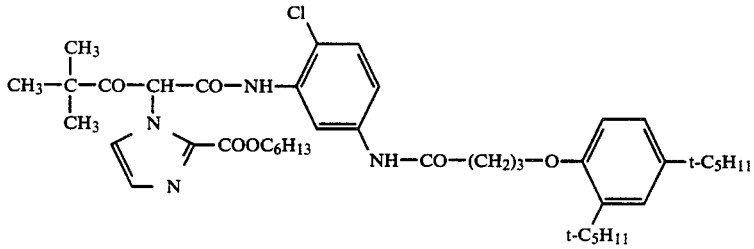

TABLE 1

| Coupler | E1-E2 | D1 | D2 | D2/D1 |
|---|---|---|---|---|
| Comparative-coupler | 3.3 | 1.46 | 1.28 | 0.88 |
| compound 1 | 1.0 | 1.40 | 1.40 | 1.00 |
| compound 4 | 1.0 | 1.32 | 1.35 | 1.02 |
| compound 7 | 0 | 1.40 | 1.40 | 1.00 |

The example shows that the yellow couplers according to the invention have excellent constant colour densities and moreover produce substantially more constant sensitivity, whether or not benzyl alcohol is present in the colour developer. On the other hand, the colour coupler according to the prior art shows a clear dependency of the sensitometric data on the content of benzyl alcohol.

We claim:

1. A colour photographic recording material with at least one photosensitive silver halide emulsion layer and a non-diffusing α-acylacetanilide yellow coupler associated therewith the anilide group of which is substituted by an N-acylsulphamoyl group, characterised in that the yellow coupler corresponds to the following formula:

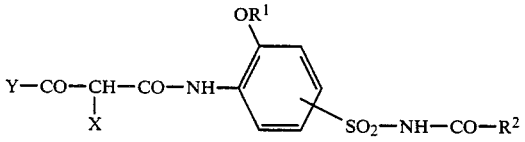

wherein:

Y represents an aliphatic or cycloaliphatic radical;

X represents a hydrogen atom or a group which can be split off during colour coupling;

$R^1$ represents an alkyl radical having from 12 to 20 carbon atoms; and $R^2$ represents an alkyl radical having from 1 to 4 carbon atoms.

2. A recording material as claimed in claim 1 wherein Y is a tert.-alkyl radical.

3. A recording material as claimed in claim 1 wherein the yellow coupler corresponds to the following formula:

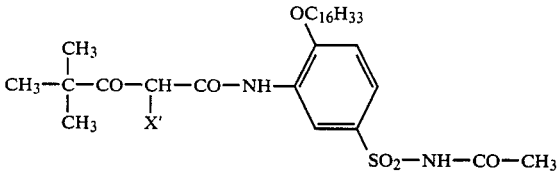

wherein X' represents a leaving cyclic group bound via an oxygen atom or a ring nitrogen atom.

4. A recording material as claimed in claim 1 wherein the yellows coupler corresponds to the following formula:

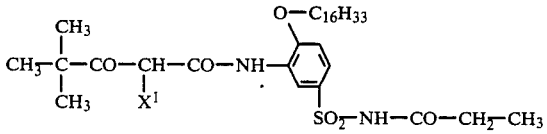

wherein X' represents a leaving cyclic group bound via an oxygen atom or a ring nitrogen atom.

* * * * *